US005755049A

United States Patent [19]

Cohen et al.

[11] Patent Number: 5,755,049

[45] Date of Patent: May 26, 1998

[54] THERMAL INSULATION COVER SET FOR STEAM AND LAUNDRY PRESS APPARATUS

[75] Inventors: Jerome H. Cohen, New York, N.Y.; Louis DeRobertis, Dunellen, N.J.; Nelson Aviles, Bronx, N.Y.

[73] Assignee: Excelsior Belting - Equipment Co., Inc., Brooklyn, N.Y.

[21] Appl. No.: 899,674

[22] Filed: Jul. 24, 1997

[51] Int. Cl.[6] ..... D06F 85/00

[52] U.S. Cl. ..... 38/66

[58] Field of Search ..... 38/66, 17, 16, 38/63, 140, 89, 95; 150/165, 901, 154

[56] References Cited

U.S. PATENT DOCUMENTS

| | | | |
|---|---|---|---|
| 2,224,781 | 12/1940 | Chew | 38/95 |
| 2,759,278 | 8/1956 | Fray | 38/95 |
| 3,266,182 | 8/1966 | Cournoyer | 38/66 X |
| 3,471,955 | 10/1969 | Cohen . | |
| 3,603,011 | 9/1971 | Cohen . | |
| 3,775,880 | 12/1973 | Gilstrap . | |
| 4,187,627 | 2/1980 | Cohen . | |

*Primary Examiner*—Ismael Izaguirre
*Attorney, Agent, or Firm*—Natter & Natter

[57] ABSTRACT

An insulation cover set for reducing heat loss from a steam press apparatus is comprised of a head cover and a buck cover, auxiliary inserts for closeout areas and a steam inlet hose wrap. A Nomex felt insulation material is utilized in combination with an aluminum sheet metal stabilizer, a vapor barrier, and a Teflon treated Nomex covering fabric. The cover set components are releasably securable to the press apparatus without requiring disassembly of the press apparatus.

20 Claims, 5 Drawing Sheets

74
66
36
71
70
64
73
72
68
38
43
40
43'
48
30
45
42
45
32
76
41
51
53
55
46
44
62
53
55
51
41
34
58
53a
55a
51a
60

THERMAL INSULATION COVER SET FOR STEAM AND LAUNDRY PRESS APPARATUS

BACKGROUND OF THE INVENTION

1. Field of the Invention

This invention relates generally to heat transfer and especially to insulation technology for the reduction of heat loss.

In particular, the invention concerns a thermal insulation cover set for steam and laundry press apparatus.

2. Background Information

Commercial laundry, dry cleaning, and garment finishing presses are typically steam heated and generally operate at temperatures approximating 300° F. A laundry press utilizes steam for heating a pressing surface. A steam press, as used in the dry cleaning industry and for garment finishing, diffuses "live" steam which passes through the pressed fabric. The press apparatus conventionally employ an overhead reciprocally moveable head which is urged against a stationary buck during the fabric pressing procedure. An average press apparatus consumes about 350,000 BTU's of energy per working day.

An inherent problem associated with steam press apparatus is inefficiency in operation due to heat loss. Another shortcoming of the press apparatus is that the high operating temperatures expose the machine operators to the danger of accidental skin burns. A further problem encountered is that the elevated air temperature of the working environment generally require fans or air conditioning for cooling purposes which consume additional energy.

A device to insulate the head of a press machine was disclosed in U.S. Pat. No. 3,775,880. A limitation of that insulator assembly is that it is molded to conform to the press head and therefore the assembly would not have universal applicability i.e. with regard to head configurations of other manufacturers. Furthermore, that insulator assembly is intended only for insulation of the press head and does not prevent heat loss from the buck or the steam inlet conduit.

The thermal insulation cover set of this invention provides a combination of insulation components and materials that provide comprehensive insulation coverage for solving many of the problems previously existent in the art.

SUMMARY OF THE INVENTION

The invention concerns a lightweight thermal insulation cover set providing reusable surface insulation for steam and laundry press apparatus.

The insulation cover set components include a head cover, a buck cover, a plurality of closeout insert members, a hose wrap, and an optional skirt member. The head and the buck covers are comprised of a layer of insulation material for reducing heat loss from the press apparatus, a vapor barrier employed for preventing moisture penetration into the insulation layer, and a pliable stabilizer member positionable contiguous to a non-pressing surface of the press apparatus. The head and buck covers are further encased in a heat-resistant fabric covering.

The closeout insert members and the hose wrap are fabricated of similar insulation material covered by a heat-resistant fabric. The buck cover additionally includes a slide panel of mesh fabric.

The insulation cover set components are attachable to each other and to the surfaces of the press apparatus by selective fastening arrangements.

An advantage of the insulation cover set of this invention is that it is compatible for use with press apparatus of different manufacturers. Another advantage of the insulation cover set is that it provides heat containment over an extensive surface area for operator safety. Additionally, the reduction of heat loss conserves energy and improves the efficiency of operation.

In view of the foregoing, it should be apparent that this invention provides an improved insulation system for steam and laundry press apparatus.

Having summarized the invention, it will be seen that it is a preferred object thereof to provide a thermal insulation cover set for steam press apparatus of the general character described herein which overcomes many of the limitations of the prior art.

Another preferred object of this invention is to provide a thermal insulation cover set that is durable, burn-out proof, cleanable, reusable and otherwise well adapted to meet conditions for practical use.

A further preferred object of this invention is to provide a thermal insulation cover set that is readily attachable to a steam press apparatus without disassembly of or interference with the operation of the press apparatus.

Yet still a further preferred object of this invention is to provide a thermal insulation cover set that increases productivity, reduces energy consumption, provides a drier steam, and produces better quality pressing of the finished product.

An additional preferred object of this invention is to provide a thermal insulation cover set that has separable interfitting components for providing maximum surface coverage.

Other preferred objects of this invention will in part be apparent and in part will be pointed out hereinafter.

With these ends in view, the invention finds embodiment in certain combinations of elements and arrangements of parts by which the aforementioned preferred objects and other certain benefits are hereinafter attained, all as more fully described with reference to the accompanying drawings and the scope of which is more particularly pointed out and indicated in the appended claims.

BRIEF DESCRIPTION OF THE DRAWINGS

In the accompanying drawings, in which is shown an exemplary embodiment of the invention.

DETAILED DESCRIPTION OF THE INVENTION

Figure 1:
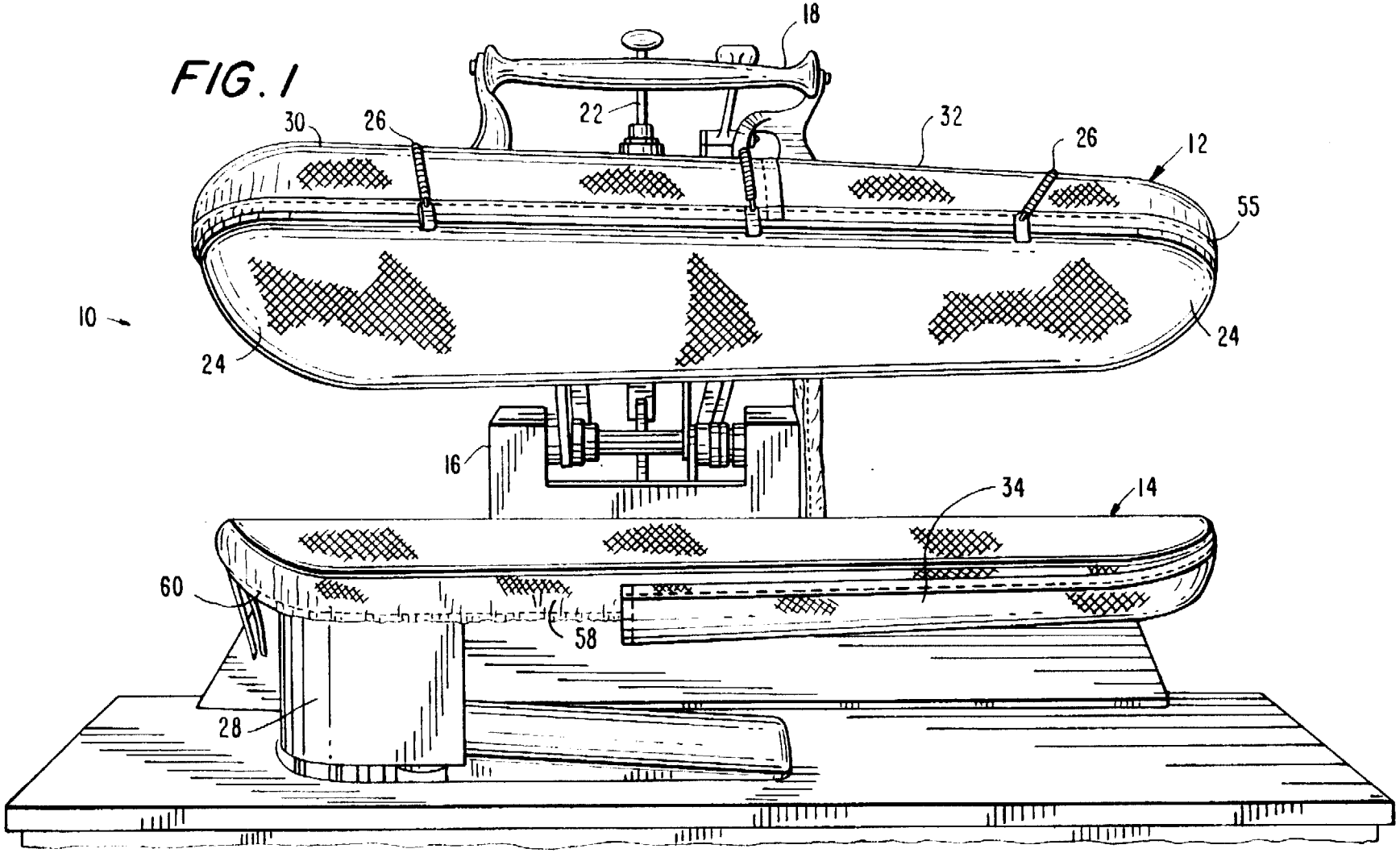
FIG. 1 is an elevational view in perspective, showing a thermal insulation cover set in accordance with this invention as applied to a steam press apparatus illustrating a head cover and a buck cover applied to a respective head member and a buck member of the press apparatus.

With specific reference now to the figures in detail, it is stressed that the particulars shown are by way of example and for the purpose of illustrative discussion of the preferred embodiment of the present invention only and are presented in the cause of providing what is believed to be the most useful and readily understood description of the principles and conceptual aspects of the invention. In this regard, no attempt is made to show construction of the invention in more detail than is necessary for a fundamental understanding of the invention, the description taken with the drawings making apparent to those skilled in the art how the invention may be embodied in practice.

The reference numeral 10 denotes generally an insulation cover set for steam and laundry press apparatus in accordance with this invention. The insulation cover set 10 is compatible for use with a steam press apparatus that typically includes a moveable head member 12, a stationary buck member 14, and a support mechanism 16 for raising and lowering the head member 12 with respect to the buck member 14. The head member 12 is shown with an operating handle assembly 18 for moving the head member 12 into and out of pressing contact with the buck member 14. A steam inlet conduit 20, e.g. a flexible hose, supplies steam to the head member 12 and a control valve 22 regulates the flow of steam during use. The head member 12 is shown with a grid plate 24 held in position by spring fasteners 26. Steam is supplied to the buck member 14 through a pedestal 28. The buck member 14 typically includes a buck pad (not shown) coextensive with the pressing surface.

Figure 4:
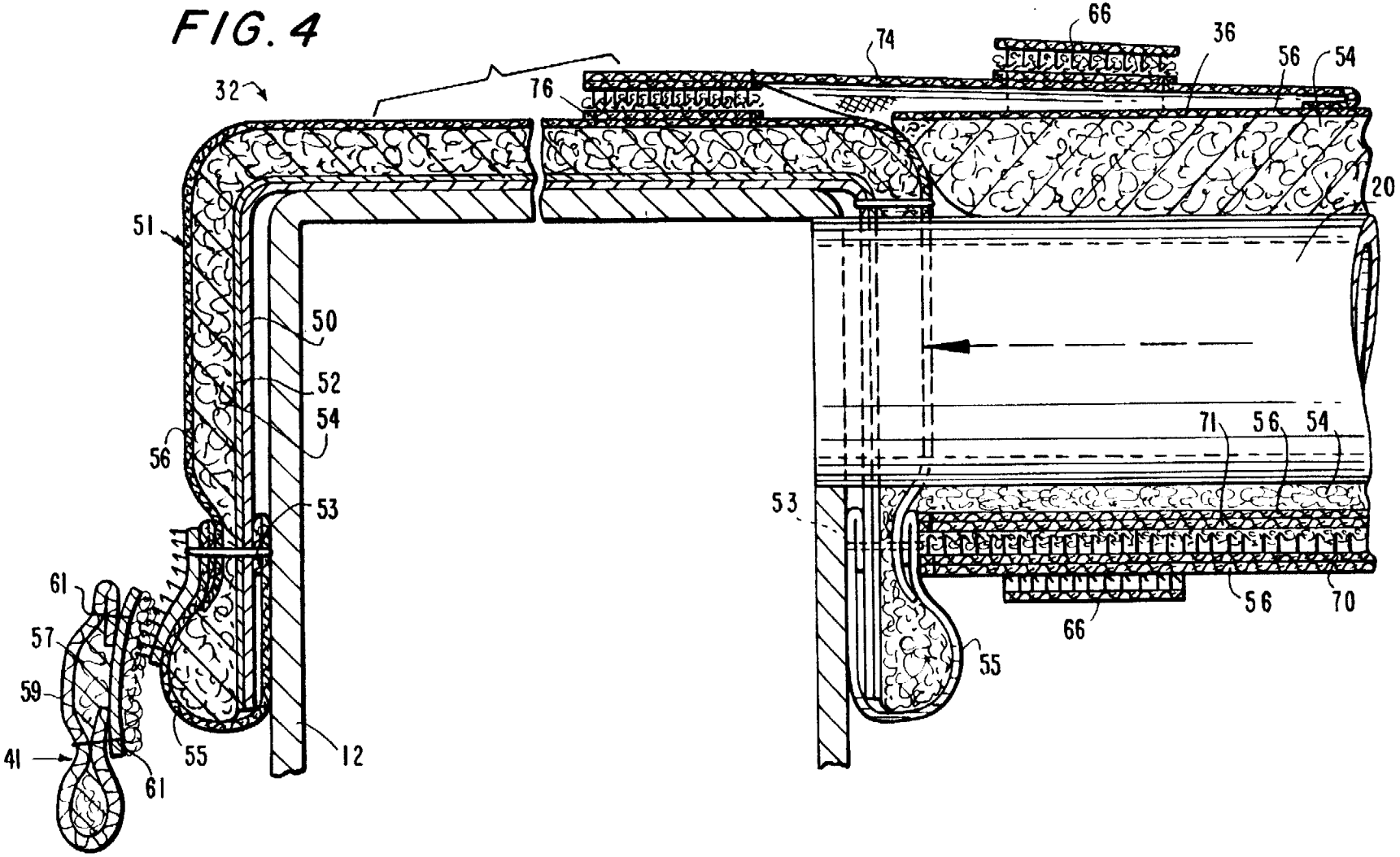
FIG. 4 is a sectional view to an enlarged scale taken substantially along line 4—4 of FIG. 3 showing in detail the construction of the head cover and the interface of the hose wrap and the head cover, an optional skirt member is shown attached to a border of the head cover.
Figure 5:
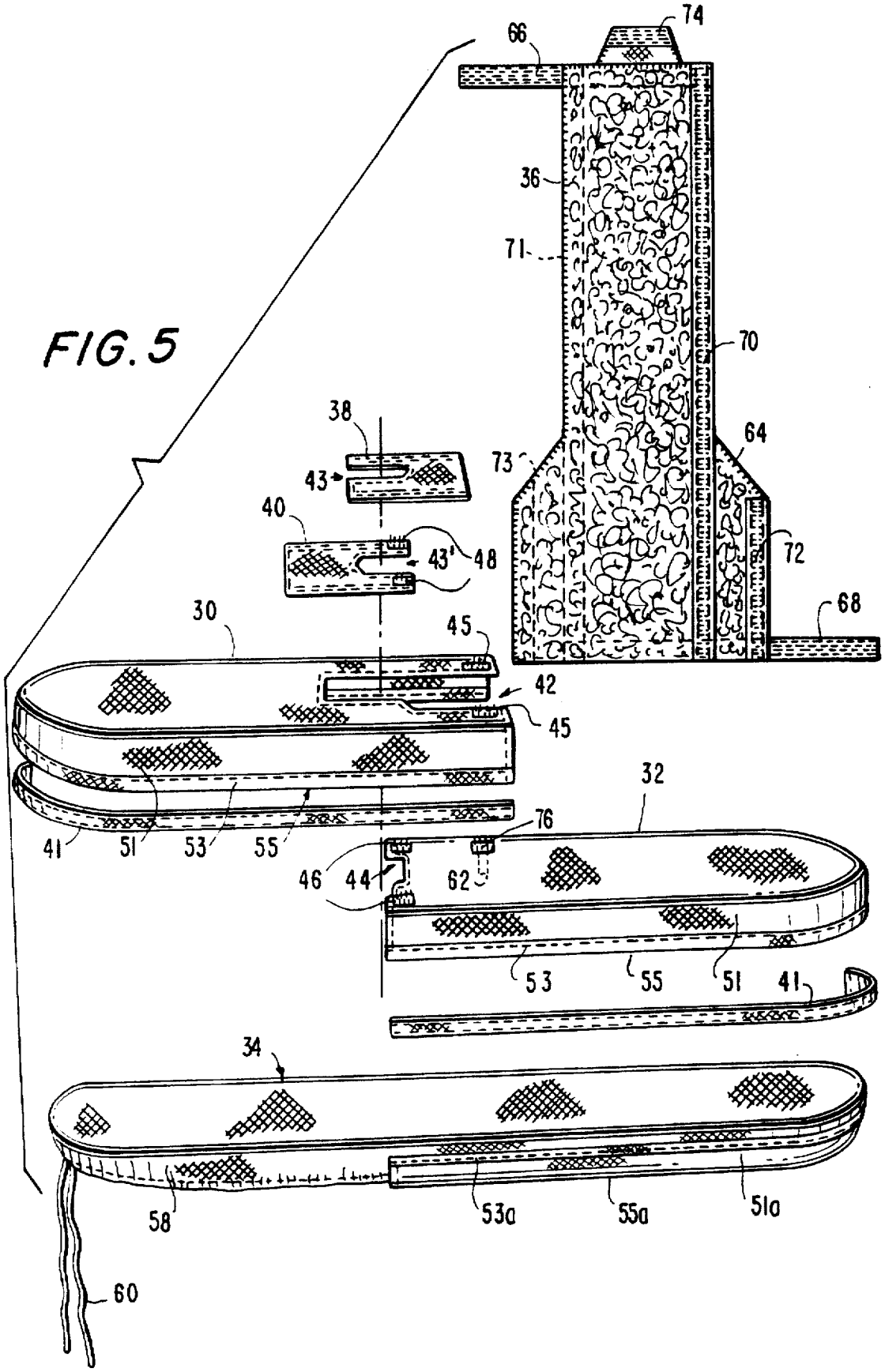
FIG. 5 is an exploded view of the insulation cover set components including the hose wrap, a pair of closeout inserts, the skirt member, the head cover and the buck cover.

The thermal insulation cover set 10, as shown in FIG. 5, includes a set of complimentary head covers 30, 32; a buck cover 34, a hose wrap 36, and a set of closeout inserts 38, 40. A skirt member 41 is adapted for optional attachment along a border of the head covers 30, 32 as shown in FIG. 4.

Figure 2:
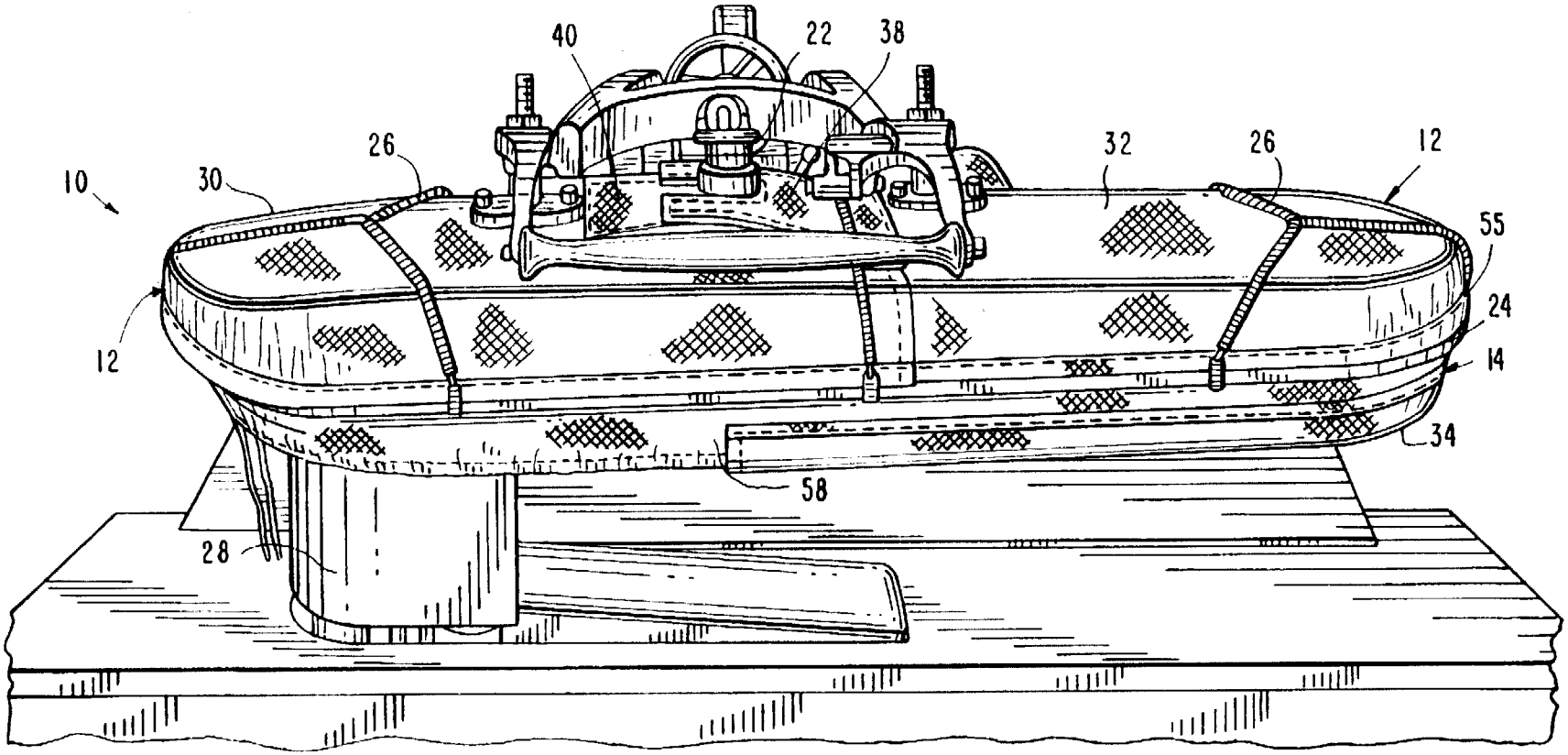
FIG. 2 is an elevational view in perspective, of the steam press apparatus of FIG. 1, in a pressing position, further illustrating the head cover and the buck cover.

The head covers 30, 32 are adapted for installation on the upper non-pressing surface of the head member 12 without requiring disassembly of the support mechanism 16, the operating handle assembly 18 or the steam control valve 22. For this purpose, the head covers 30, 32 are provided with respective cutout areas 42, 44 adapted to accommodate the operating handle assembly 18 and the control valve 22. When seated on the upper surface of the head member 12, the head cover 30 is adapted to overlap a portion of the head cover 32 as shown in FIGS. 1 and 2. The respective head covers 30, 32 are secured to each other by engagement of a set of tab fasteners 46 with a corresponding set of tab fasteners affixed to the underside of the head cover 30 (not shown). The spring fasteners 26 holding the grid plate 24 can be used to secure the head covers 30,32 to the head member 12. However, it should be noted that other securement arrangements such as magnetic clips, mating hook and loop material, mechanical clamps, adhesive bonding and the like can be substituted.

A pair of closeout insert members 38, 40, each defining a respective slot 43 43', for accommodating the control valve 22, are positionable in overlapping relationship with the cutout areas 42, 44 and are adapted to snugly surround the control valve 22, as shown in FIG. 2. The closeout insert member 40 includes a set of tab fasteners 48 which are registrable with a set of tab fasteners (not shown), affixed to the underside of the closeout insert member 38. Similarly, the closeout insert member 40 is attachable to the head cover 30 by engagement of a further set of tab fasteners 45 on the head cover 32.

By way of example, the respective sets of tab fasteners 45, 46, 48 may be provided with mating hook and loop material, such as manufactured under the trademark Velcro, or may utilize equivalent attachment devices.

The cover members 30, 32 are each substantially identical in construction and both members will be described with reference to the cover member 32. The innermost layer, of the multiple layer construction, includes a substantial planar stabilizer member 50, preferably made of a pliable sheet metal, e.g. 0.03 in. thickness aluminum sheet material. The stabilizer member 50 provides integrity to the cover members 30, 32 to facilitate the handling and has the necessary pliancy for conformable placement contiguous to the non-pressing surface of the press apparatus. As will be observed, the cover member 32 also includes a flange 51 to provide insulation coverage for the sides of the head member 12.

A vapor barrier 52, such as a moisture impervious metallic foil material, a neoprene-coated fabric, or the like overlies the stabilizer member 50. Adjacent the vapor barrier 52 is a layer of heat-resistant insulating batting preferably a flexible felt material 54 having a low coefficient of heat conductivity e.g., Nomex felt manufactured by Dupont. The vapor barrier 52 prevents moisture from contaminating the felt 54 or adversely affecting the insulating characteristics. A fabric covering 56 is secured e.g. by a series of stitches 53, to form a hemmed border 55. The stabilizer 50, may be perforated to accommodate stitches 53. The fabric covering 56 is preferably a cleanable, heat-resistant fabric such as a Teflon-coated Nomex fabric.

Additional insulation coverage, to prevent heat loss and/or accidental operator contact, is provided along the border 55 of the head covers 30, 32, by a skirt member 41. The skirt member 41 is comprised of a strip of flexible felt material 57 (e.g. Nomex felt) of sufficient length dimension to be coextensive with the hemmed border 55. A fabric covering 59 (e.g. Teflon coated Nomex fabric) is stitched at 61 for enveloping the felt material 57. The skirt 41 is releasably attachable (e.g. by Velcro type material) at selected heights, so as to effectively extend the insulation coverage of the flange 51 for accommodating various size press heads.

The buck cover 34 is constructed in a substantially similar manner as the head covers 30, 32 and will be described with the same reference numerals, for designating corresponding elements, with the suffix "a". Access to the underside or non-pressing surface of the buck member 14 is limited in view of the obstruction presented by the pedestal 28. The buck cover 34 is provided with a panel 58, preferably made of heat-resistant fabric such as Teflon treated Nomex mesh fabric. The panel 58 conforms generally to the dimensions of the buck pressing surface and is sewn by a series of stitches **53*a* to form a hemmed border 55*a* located at an edge of a buck cover flange 51*a*. A segment of the panel 58 extends beyond a flange 51*a* as shown in FIG. 5. Additionally, the panel 58 includes a drawstring 60 for providing auxiliary fastening to secure the buck cover 34 to the buck member 14**.

Figure 3:
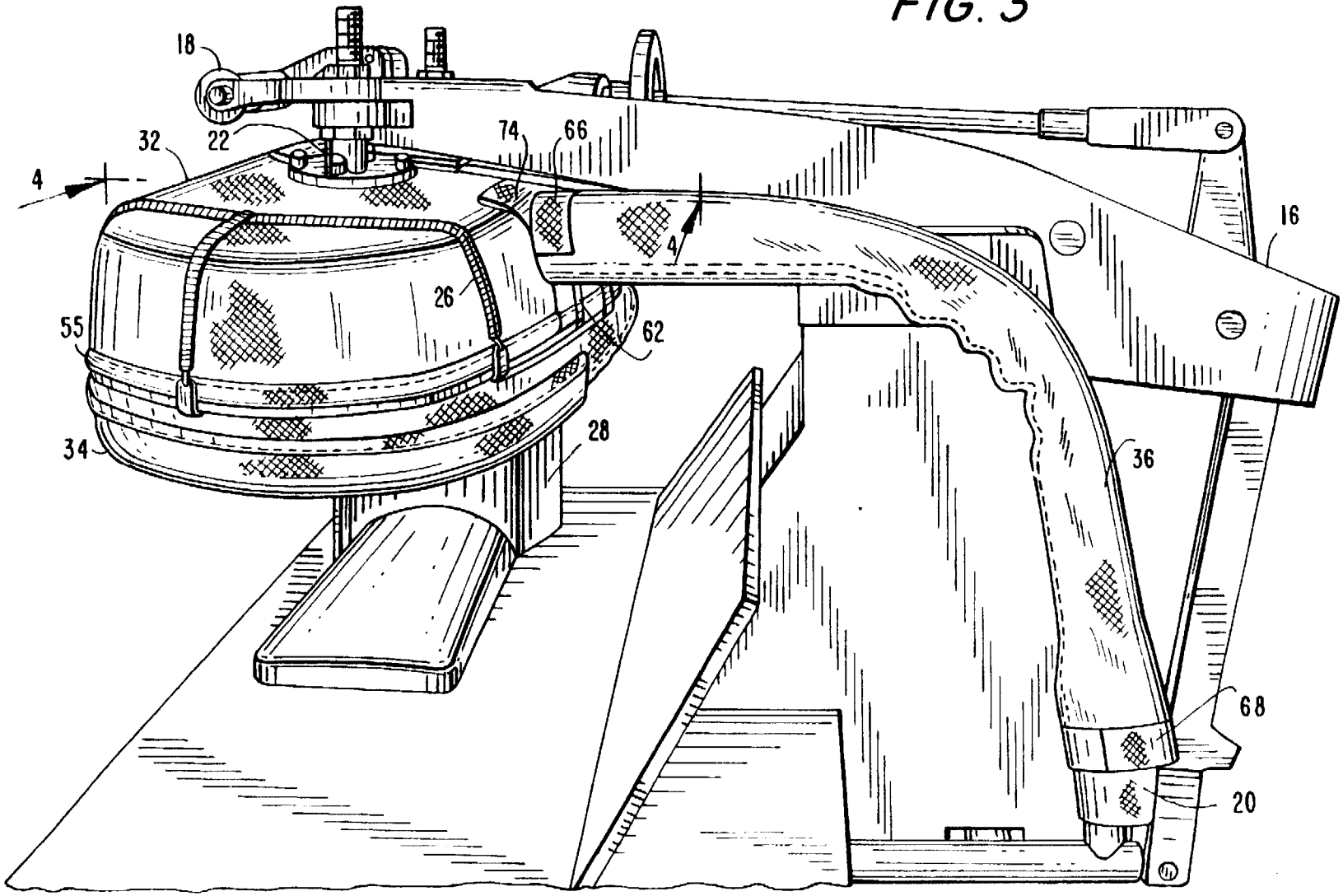
FIG. 3 is a side elevational view of the steam press apparatus of FIG. 2 showing a support mechanism for raising and lowering the head member and illustrating a hose wrap applied to a steam inlet conduit.

The installation of the head covers 30, 32 will now be described. The head member 12 is lowered, as shown in FIG. 2, and the spring fasteners 26 are unhooked. The head cover 32 is placed over one side (right side as shown in FIG. 2) of the upper surface of the head member 12 and slid into position. The stabilizer member 50 yieldably conforms to the general contour of the upper surface as the head cover 32 is urged against the head member 12, to provide a substantially close fit. The head cover 30 is then positioned in a similar manner, on the opposite side of the head member 12, in overlapping relationship with respect to the cover 32 and in registered alignment for engagement with the set of tab fasteners 46. The closeout insert members 38, 40 are then secured in overlapping relationship with regard to the cutout areas 42, 44. It should be noted that the flange 51 on the head cover 30 is provided with a slot 62 (see FIGS. 3 and 5) for accessing the steam inlet conduit 20. Furthermore, the skirt member 41 may be optionally attached to the border 55 of the head cover 30 as needed.

The buck cover 34 is installed over the buck member 14 by first removing the buck press pad (not shown) from the pressing surface and by then sliding the panel 58 over the pressing surface of the buck member 14. The drawstring 60 is tightened and tied to fasten the buck cover 34 in place. The buck press pad is then replaced over the panel 58 to restore the pressing surface.

In accordance, with the comprehensive thermal insulation coverage provided by this invention, the hose wrap 36 is placed around the steam inlet conduit 20. As noted in FIG. 5, the hose wrap 36 has a substantially rectangular configuration including a flared portion 64 for surrounding a steam manifold shield (not shown) of the steam inlet conduit 20. Furthermore, the hose wrap 36 includes a set of straps 66, 68, a plurality of fastener strips 70,71,72,73 and a tag 74. The hose wrap 36 is adapted to envelop the steam inlet conduit 20 by engagement of the fastener strip 70 with the corresponding fastener strip 71 on the reverse side of the hose wrap 36. The hose wrap 36 enclosure can be adjustable enlarged, for example, to accommodate a steam manifold, by selective use of the fastener strip 72 and corresponding the fastener strip 73 on the reverse side of the hose wrap 36. The straps 66, 68 have matings surface segments on opposed sides and are engagable as shown in FIG. 4. Additionally, the tag 74 is registrable with and attachable to a tag 76 on the head cover 32.

For the purpose of this embodiment, the strips 70,71,72, 73 and the straps 66,68, utilize Velcro material for mating engagement.

With regard to the construction of the hose wrap 36, a heat-resistent layer of batting or felt 54, such as Nomex felt is backed by a Teflon treated Nomex fabric covering 56.

By way of further example, the thickness of the felt layer, as applied to the cover members 30, 32, 34 is 0.5 in. The thickness of the felt layer on the hose wrap 36, closeout insert members 38,40 and skirt member 41 is approximately 0.25 in.

The use of the thermal insulation cover set of this invention reduces the heat radiated from the non-pressing surfaces of typical press apparatus and lowers the temperature from approximately 300° F. to about 120° F. The "live" steam on the pressing surface is drier and the quality of the pressed finished goods is improved.

It should thus be seen that there is provided an insulation cover set for steam and laundry press apparatus which achieves the various preferred objects of this invention and which is well adapted to meet conditions of practical use. Since various possible embodiments might be made of the present invention or modifications might be made to the exemplary embodiment set forth above, it is to be understood that all materials shown and described in the accompanying drawings are to be interpreted as illustrative and not in a limiting sense.

Having thus described the invention, there is claimed as new and desired to be secured by Letters Patent:

1. A thermal insulation cover set for a steam and laundry press apparatus, said press apparatus having a head member and a buck member each of said members defining a respective confronting functional pressing surface and a non-functional surface, said insulation cover set comprising pliably conformable cover means for providing a thermal barrier, fastening means for concurrently securing the cover means contiguous to the non-functional surface of the head member and the buck member to reduce heat loss from the non-functional surface.

2. A thermal insulation cover set as claimed in claim 1 wherein said cover means includes two complimentary head covers, said head covers being attachable in interfitting relationship over the head member without requiring disassembly of the head member.

3. A thermal insulation cover set as claimed in claim 2 wherein the cover members include cutout areas for accommodating at least one of an operating handle assembly and a steam control valve projecting from the head member.

4. A thermal insulation cover set as claimed in claim 3 further including closeout insert means, said insert means being attachable to the head covers in overlying relationship for insulating the cutout areas.

5. A thermal insulation cover set as claimed in claim 1 wherein the cover means includes a buck cover, said buck cover having panel means for seating the buck cover on the non-functional surface of the buck member.

6. A buck cover as claimed in claim 5 wherein the panel means is slidable over the pressing surface of the buck member for seating the buck cover on the buck member.

7. A thermal insulation cover set as claimed in claim 6 further including auxiliary fastening means cooperating with the panel means for seating the buck cover on the buck member.

8. A thermal insulation cover set as claimed in claim 1 wherein the cover means is comprised of stabilizer means, vapor barrier means, insulating means, and heat-resistant covering means.

9. A thermal insulation cover set as claimed in claim 8 wherein the stabilizer means is fabricated from pliable metallic sheet material.

10. A thermal insulation cover set as claimed in claim 8 wherein the vapor barrier means is fabricated from a moisture impervious metallic foil material.

11. A thermal insulation cover set as claimed in claim 8 wherein the insulating means is a heat-resistant flexible felt material.

12. A thermal insulation cover set as claimed in claim 8 wherein the covering means is a heat-resistant fabric.

13. A thermal insulation cover set as claimed in claim 1 further including hose wrap means for insulating a steam inlet conduit connected to the press apparatus.

14. A thermal insulation cover set as claimed in claim 13 wherein the hose wrap means is comprised of heat-resistent flexible felt material.

15. A thermal insulation cover set as claimed in claim 1 further including a skirt member, said skirt member being adjustably attachable to a border of the cover means, said skirt member having a length dimension substantially coextensive with the border.

16. A thermal insulation cover set for steam and laundry press apparatus, said press apparatus having a head member and a buck member, each of said members defining a respective confronting functional pressing surface and a non-functional surface, said insulation cover set comprising cover means for reducing heat loss from the non-functional surface of the press apparatus, said cover means being yieldably for substantial conformance to the contours of the non-functional surface of at least one of the head member and the buck member, attachment means for urging the cover means into substantially close fit with the non-functional surface whereby said cover means provide for a drier steam at the pressing surface.

17. A thermal insulation cover set for steam and laundry press apparatus, said press apparatus having a head member and a buck member, each of said members defining a respective confronting functional pressing surface and a non-functional surface, said press apparatus further being connected to a steam supply conduit, said cover set comprising a set of head covers and a buck cover, said head covers being adapted for installation over the non-functional surface of the head member and said buck cover being adapted for installation over the non-functional surface of the buck member.

18. A thermal insulation cover set as claimed in claim 17 further including a hose wrap securable around the steam supply conduit for reducing heat loss from the conduit.

19. A thermal insulation cover set as claimed in claim 17 further including complimentary head covers, said head covers defining a conforming opening for accommodating a control valve mounted to the head member.

20. A thermal insulation cover set as claimed in claim 17 further including an auxiliary insert member, said insert member being positionable over the conforming opening in surrounding relationship to the control valve.

* * * * *